US008317632B2

(12) United States Patent
Nemeth et al.

(10) Patent No.: US 8,317,632 B2
(45) Date of Patent: Nov. 27, 2012

(54) HIGH AND LOW FLYER RIDE

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 311 days.

(21) Appl. No.: 12/877,243

(22) Filed: Sep. 8, 2010

(65) Prior Publication Data

US 2012/0058833 A1 Mar. 8, 2012

(51) Int. Cl.
*A63G 1/08* (2006.01)
*A63G 1/30* (2006.01)

(52) U.S. Cl. ..... 472/39; 472/130

(58) Field of Classification Search ..... 472/1, 6, 472/7, 9, 11, 29, 39, 130
See application file for complete search history.

(56) References Cited

U.S. PATENT DOCUMENTS

| | | | | |
|---|---|---|---|---|
| 2,312,533 | A | 3/1943 | Eyerly | |
| 2,468,893 | A * | 5/1949 | Orance | 472/39 |
| 3,498,604 | A | 3/1970 | Schwarzkopf | |
| 3,598,403 | A | 8/1971 | Bartlett | |
| 3,707,282 | A | 12/1972 | Robinson | |
| 3,840,225 | A | 10/1974 | Fouche | |
| 7,846,032 | B2 * | 12/2010 | Zamperla et al. | 472/34 |
| 2004/0116194 | A1 | 6/2004 | Comand | |
| 2006/0154735 | A1 | 7/2006 | Zamperla et al. | |
| 2007/0049383 | A1 | 3/2007 | Fabbri | |

FOREIGN PATENT DOCUMENTS

| | | | |
|---|---|---|---|
| DE | 4137502 | A1 | 6/1992 |
| EP | 0325783 | A1 | 8/1989 |
| WO | 2008059356 | A2 | 5/2008 |

* cited by examiner

*Primary Examiner* — Kien Nguyen
(74) *Attorney, Agent, or Firm* — Marsh Fischmann & Breyfogle, LLP; Kent M. Lembke

(57) ABSTRACT

A round ride is selectively placing passenger vehicles in one of two or more workspaces or vehicle fly zones. The ride includes a drive assembly including a rotating hub structure and a plurality of vehicle support assemblies mounted to the hub. Each of the vehicle support assemblies includes: (a) a vehicle; (b) a support arm supporting the vehicle proximate to a first end; (c) a base pivotally supporting the arm; and (d) a base angle mechanism mounted to the rotatable structure and selectively operable to position the base into a low position and a high position. The vehicle support assemblies are grouped into first and second sets including alternating ones of the vehicle support assemblies. The base angle mechanisms positions the first set of vehicle support assemblies in the low position and the second set of vehicle support assemblies in the high position and later swaps the positions.

23 Claims, 11 Drawing Sheets

HIGH AND LOW FLYER RIDE

BACKGROUND

1. Field of the Description

The present description relates, in general, to amusement park rides and other entertainment rides such as round rides, and, more particularly, to amusement or theme park round rides configured to position passenger vehicles, which are mounted upon the ends of support or main arms, in at least two ride zones such as a first ride zone (i.e., a low zone) and a second ride zone (i.e., a high zone) to increase ride capacity while maintaining typical footprint and ride vehicle spacing characteristics. Passenger ride experiences are also enhanced by providing a larger range of vehicle speeds, a greater range of vehicle heights, and an improved amount of vehicle-to-vehicle interaction during swaps between ride or fly zones.

2. Relevant Background

Amusement and theme parks are popular worldwide with hundreds of millions of people visiting the parks each year. Park operators continuously seek new designs for rides that attract and entertain guests in new ways. Many parks include round rides that include vehicles or gondolas mounted on support arms extending outward from a centrally located hub or rotation assembly. The passengers or riders sit in the vehicles and are rotated in a circle about the drive assembly, which spins about its central axis. In some of these rides, the passengers may operate an interactive device, such as a joystick in the vehicle, to make the support arm and their attached vehicle gradually move upward or downward within a limited, preset range (e.g., from about horizontal to a 45 degree angle relative to horizontal or the platform upon which the drive assembly is mounted). Some rides also allow the passengers to control the pitch of their vehicle.

A goal of park operators is to increase the number of passengers or riders that can experience each ride to improve the capacity and thereby limit the time spent waiting in lines. One of the biggest issues with multi-arm round rides is that there is a capacity limitation that is based on the number of arms that can be connected to the rotating center structure. In many round rides, the support arms are movable by the vehicle passengers or by a ride control system through a fixed range of angles such as through 45 degrees, and this vertical angle range may be thought of as a fixed or limited motion workspace or fly zone. As a result, the number of arms and attached passenger vehicles is limited by the number of vehicles that can be positioned about the circumference of the circle defined by the end of the support arms when they are at their most vertical orientation. Particularly, the vehicles cannot contact each other or interfere not only at the low point of the workspace where the circle is larger but also at the high point of the workspace at which point the circumference of the circle is much smaller. For example, a ride may be able to accommodate 20 vehicles and support arms when the support arms are at a lower point of the limited motion workspace or fly zone, but, due to vehicle interference, the ride may only be able to accommodate 16 vehicles at higher points of the fly zone (such as nearer to 45 degrees from the horizontal plane). In other words, the capacity is limited by vehicle spacing in the circular flight path of vehicles at the high end of the fly zone.

In addition to physical limitations based on available space, there are experiential limitations to round rides that may dictate use of fewer than the maximum number of support arms and passenger vehicles that could be used in the ride. For example, in round rides, it is generally not desirable to allow adjacent vehicles (a leading vehicle and a following vehicle) to be too close together because the passengers' sightlines are typically severely obstructed as all the following vehicle may see is the tail portion of the leading vehicle. If the vehicles are tightly packed together, the passengers may feel cramped and not enjoy the ride experience. Also, since all the vehicles move through the same fly zone (e.g., a 45 degree workspace), adding more and more vehicles increases the number of arms moving through this workspace, which further exacerbates sightline problems and can create a general unpleasant feeling of congestion.

Hence, there remains a need for new round rides that address capacity issues while retaining desirable characteristics such as a small footprint, guest control of vehicle elevation, and relatively simple rotation and arm positioning assemblies. Preferably, the new rides would also improve other aspects of the ride experience such as by providing enhanced sightlines and a larger range of ride dynamics (e.g., bigger range of vehicle speeds than achievable with a 0 to 45 degree workspace) and by providing variation within the ride such that there are multiple, different experiences within the same ride cycle.

SUMMARY

The present invention addresses the above problems by providing a new type of ride for use in amusement and theme parks that retains the desirable features and the footprint of existing round rides while providing a larger range of ride dynamics and experiences (e.g., differing velocities due to a larger range of radial distances), providing a bigger range of sight lines (e.g., allowing vehicles to be moved through larger height ranges), and providing improved vehicle capacity. The new rides achieve these benefits by providing vehicle support assemblies that allow a vehicle support arm to be moved through a range of angular positions about a base and by also selectively positioning the base in one, two, or more workspace positions (e.g., a low flyer workspace or zone and a high flyer workspace or zone). The base is attached to a central, rotating hub of the ride, and a ride control system operates a high-low pivot actuator or other base angle mechanism to move the base to the various workspace positions (and lock or retain the vehicle support assemblies in such workspaces).

In one embodiment, for example, half of the vehicle support assemblies (and attached/supported passenger vehicles) are positioned in a high flyer zone and half of the vehicle support assemblies (e.g., every other assembly such that adjacent assemblies are operated as sets moved in unison between the various flyer zones or workspaces) are positioned in a low flyer zone. In this way, the capacity of the ride is increased as prior rides were limited in capacity because vehicles would interfere with each other when support arms were moved above a particular upper boundary (such as arm angular orientations over 45 degrees or the like).

In contrast, the ride embodiments described herein provide improved sightlines and more space between vehicles by moving half of the vehicles and their support arms up into a high flyer zone while preventing the other half from moving past some preset upper arm travel boundary (e.g., 0 to 45 degree arm travel may be in the low flyer zone and 45 to 90 degree arm travel may in the high flyer zone). In a later portion of the ride sequence, the vehicle support assemblies may be operated to swap positions with those in the high flyer zone dropping down to the low flyer zone and vice versa via the ride control system operating the high-low pivot actuator to pivot the bases to which the arms are pivotally mounted.

More particularly, a ride apparatus or round ride is provided that selectively places passenger vehicles in one of two or more workspaces or vehicle fly zones. The ride includes a drive assembly including a structure rotatable about a central axis and a plurality of vehicle support assemblies mounted to the rotatable structure. Each of the vehicle support assemblies includes: (a) a passenger vehicle; (b) a vehicle support arm supporting the passenger vehicle proximate a first end; (c) a base with a second end distal to the first end of the vehicle support arm mounted to this base; and (d) a base angle mechanism mounted to the rotatable structure and operable to position the base into one of a low position and a high position. In the round ride, the vehicle support assemblies may be grouped into first and second sets including alternating ones of the vehicle support assemblies (e.g., odd numbered assemblies in one set and even numbered assemblies in the other set). The base angle mechanisms may be operated to position the first set of vehicle support assemblies in the low position and the second set of vehicle support assemblies in the high position.

Each of the base angle mechanisms may include a housing affixed to the rotatable structure. Further, each of the bases may be pivotally attached to the corresponding housing of the base angle mechanism, with each of the base angle mechanisms including a high-low pivot actuator attached at a first end to the housing and at a second end to the base to pivot the base to the high position when the actuator is extended. In the round ride, in each of the vehicle support assemblies, the second end of the vehicle support arm may be pivotally mounted to the base. Also, each of the vehicle support assemblies may further include a passenger-controlled mechanism operable in response to passenger operation of an input device associated with the passenger vehicle to pivot the vehicle support arm through an angular range of motion.

In some embodiments of the round ride, the angular ranges of motion of the vehicle support assemblies in the low position are at least partially non-overlapping with the angular ranges of motion of the vehicle support assemblies in the high position, e.g., such that the passenger vehicles in the high position have clearance from adjacent ones of the passenger vehicles in the low position. Also, the angular ranges of motion may sweep the vehicle support arm through an angle of about 45 degrees (e.g., the workspaces or flyer zones may be in the range of about 30 and 60 degrees such as about 45 degrees). In some cases, the base is moved between the low and high positions by the base angle mechanism pivoting the base about a high-low pivot element through an angle of rotation selected from the range of 30 to 60 degrees. The base angle mechanisms may be operated concurrently to move a first half of the vehicle support assemblies from the high position to the low position and to move a second half of the vehicle support assemblies from the low position to the high position, e.g., such that adjacent ones of the passenger vehicles temporarily have equal angular orientations defined by the vehicle support arms relative to a horizontal plane.

According to another aspect, a method is provided for operating a round ride including a plurality of vehicle support assemblies extending from a rotatable central hub. In the method, first positioning is performed by a ride controller to position all of the vehicle support assemblies in a low flyer zone. Such first positioning may include operating a base angle mechanism to pivot a base of each of the vehicle support assemblies into a low position. The method may also include rotating the central hub about a central axis at a rotation rate. Then, with the controller, the method may include second positioning alternating ones of the vehicle support assemblies into a high flyer zone. The second positioning may include operating the base angle mechanism to pivot the base of each of the alternating ones of the vehicle support assemblies from the low position to a high position at a predefined angular offset. The angular offset may be at least about 45 degrees in some applications.

In some embodiments, after the second positioning, the method includes third positioning the vehicle support assemblies positioned (during the second positioning step) in the high flyer zone into the low flyer zone and the vehicle support assemblies positioned in the low flyer zone into the high flyer zone (e.g., performing a swapping sequence). In the method, each of the vehicle support assemblies may include an arm supporting a passenger vehicle and further, in each of the vehicle support assemblies, the arm may be pivotally mounted to the base. Still further, each of the vehicle support assemblies may include an arm pivot actuator operable to pivot the arm relative to the base through an angular range of motion.

In some embodiments of the method, the angular range of motion of the arms of the vehicle support assemblies in the low position and the angular range of motion of the arms of the vehicle support assemblies in the high position are defined such that the low and high flyer zones have a region of overlap. Also, the angular range of motion of the arms may be at least about 45 degrees with the arm pivot actuator operating in response to passenger input (e.g., the ride control acts to place sets of vehicles into either the high or low flyer zone at which point passengers may operate an input devices such as a joystick to move their vehicle within the zone (e.g., through 0 to 45 degrees of arm travel or the like)).

BRIEF DESCRIPTION OF THE DRAWINGS

FIG. 5 shows the vehicle support assembly of FIG. 4 operating to position a vehicle in a range of vertical positions (or angular positions of a main or support arm) associated with a low workspace/low flying zone (note, the range of motion an;

DETAILED DESCRIPTION

Figure 1:
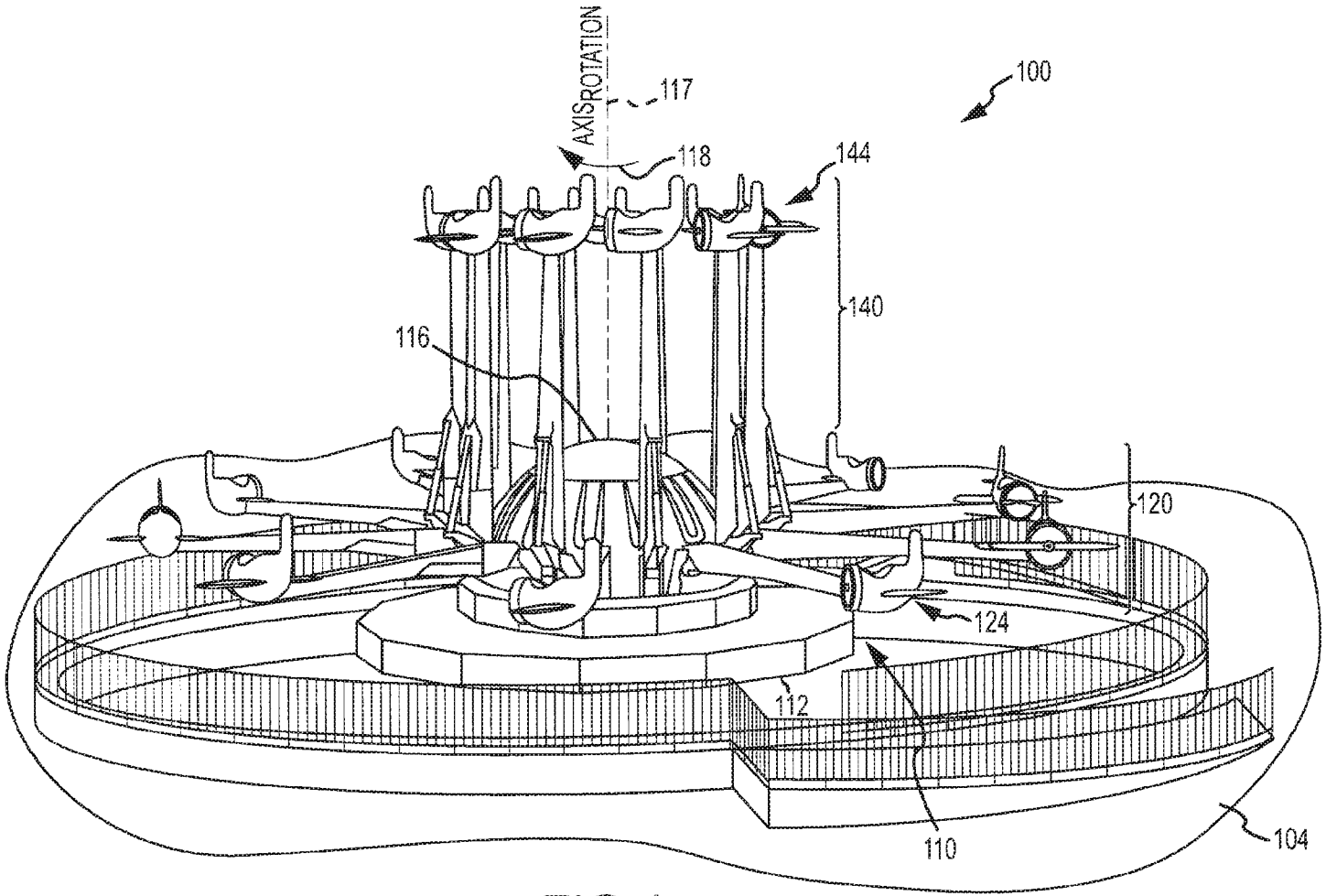
FIG. 1 is a perspective view of a high and low round ride (high-low flyer ride or the like) according to one embodiment showing one set of vehicles in a high flying zone (ride high zone, high or upper workspace, or the like) and a second set of vehicles in a low flying zone (ride low zone, low or lower workspace, or the like), with the first set all shown at a highest vertical position and the second set all shown at a lowest vertical position within the high and low flying zones.

The description is generally directed to an amusement park ride that provides enhanced passenger or rider interactivity and sight lines in a round ride, which also has significantly higher attraction capacity. Briefly, a high-low flyer ride system is described that includes multiple vehicles attached to a central rotating structure or hub, which typically is supported on a horizontal platform (the "ground" plane). The vehicles are each pivotally coupled to the rotating (or rotatable) center structure via a cantilevered support or main arm.

In contrast to prior round rides, a base angle mechanism may be pivotally connected or linked to a base of the main arm, and the base angle mechanism is operable (such as by a ride control system) to position a first set of arms (and attached vehicles) in a first workspace (e.g., a low flying zone) and a second set of arms (and attached vehicles) in a second workspace (e.g., a high flying zone offset from or overlapping the low flying zone). The base angle mechanism is operated or controlled so as to limit the position of the arms/vehicles to one of the two (or more) workspaces so as to allow or disallow particular individual vehicles into the two or more workspaces. Typically, alternating arms about the circumference of the center rotatable hub or structure are assigned to the two sets, e.g., every other arm/vehicle is placed in differing sets such that adjacent arms/vehicles fly or ride within differing zones/workspaces, thus allowing for significantly larger spacing between adjacent vehicles located in the same zone.

Further, each arm is capable of pivoting about the base so as to position the arm (and attached vehicle) in a limited range of angular positions, such as based on input from a passenger control on the vehicle (e.g., a joystick or the like). In some embodiments, each arm may be positioned or rotated through a range of arm travel of about 45 degrees through operation of a passenger-controlled mechanism. For example, an actuator may be mounted to the pivotable base and act to push on the support or main arm to pivot it away from the base and rotate the arm through the workspace in response to passenger inputs. The vehicles are supported and/or positioned through the use of vehicle support assemblies, which, as noted above, may be thought of as using a nested actuator system including a combination of a base angle mechanism and a passenger-controlled mechanism to provide two or more fly zones or workspaces (that may or may not overlap in a midrange/overlap zone) and to provide rider-controlled movement within each fly zone or workspace.

The high-low flyer ride systems described herein provide a number of advantages over prior multi-arm round rides. The ride systems provide a higher range of motion (not limited to 45 degree or the like arm orientation) by only allowing a subset of the vehicles (e.g., half of the vehicles) into the higher range at one time. The high points may be used to provide "peek-a-boo" or other unique visual ride/show effects such as by providing theme, character, and other features at higher ride set locations, which may give passengers an incentive to move up to the higher ride positions. The ride systems provide better sight lines and a more unique, varied passenger experience while delivering higher capacity with some designs likely providing 25 percent more vehicles than traditional multi-arm round rides.

Thrill and fun are enhanced by the close proximity of vehicles during "swap" between the two workspaces such as when the high riders switch places with the low riders. Adjacent vehicle spacing is significantly and rapidly reduced in a transition zone (such as at or near a boundary between the two workspaces when there is no overlap or within a midrange or overlapping workspace when overlap is allowed). Ride dynamics (e.g., angular velocity of the vehicles) varies dramatically throughout the ride experience as the radial distance of the vehicle is changed, with the ride being relatively slow at highest points of a high flying zone coinciding with a smaller radial distance or circular path diameter and being relatively fast at lowest points of a low flying zone coinciding with a larger radial distance or circular path diameter.

FIG. 1 illustrates a high and low flyer round ride 100 of one embodiment. Generally, as shown from the perspective view in FIG. 1, the ride 100 is built upon or provided through use of a multi-arm round ride platform. With this in mind as one useful, but not limiting example, the ride 100 may include a drive and support assembly 110, which may be configured as for a typical round iron ride, e.g., may take the form of one of the drive and support assemblies designed and distributed by Zamperla Inc., 49 Fanny Road, Parsippany, N.J., USA or assemblies provided by other similar ride design and production companies. Often, such an assembly 110 only operates at relatively low speeds such as less than about 20 revolutions per minute (RPM) and more typically less than about 10 RPM such as about 6 RPM in some cases. The control and actuation systems and methods described herein for inclusion in ride 100 for controlling arm positions via nested arm actuators to selectively pivot booms or support/main arms are well suited for use with these low RPM drive assemblies 110 to provide a wide range of ride dynamics as the radial distance is varied during rotation 118 about the center axis 117 of the assembly 110.

The ride 100 includes the drive and support assembly 110 with a center support structure 116 that is positioned upon a base 112, which may be supported on platform, foundation, or ground 104. Significantly, the ride 100 includes a first set 120 of vehicle support assemblies 124 and a second set 140 of vehicle support assemblies 144. An exemplary configuration for a vehicle support assembly, such as assemblies 124, 144, is described below with reference to FIG. 4, but, generally, each assembly 124, 144 includes a main arm with a passenger vehicle mounted on one end and pivotally mounted at the other end to a base, which is, in turn, pivotally supported by the center support structure 116 via a base angle mechanism/assembly.

The support structure 116 houses or supports a plurality of arm actuators or base angle mechanisms for pivoting bases supporting booms or support arms of vehicle support assemblies 124, 144. In this manner, the support arms/vehicles of the first set 120 may be positioned (and locked temporarily) into a low, workspace or low flyer zone while the second set 140 may be positioned (and locked temporarily) into a high workspace or high flyer zone. The support structure 116 is also adapted to drive the ride 100 by rotating as shown with arrow 118 about a center axis 117. The speed at which it rotates may be relatively high such as up to 15 to 20 RPM or more, but, in more common applications, the rotation 118 will be less than about 8 to 10 RPM such as about 6 RPM. Also, the rotation 118 may be a constant rate or it may be varied during the course of operating the ride 100. In some cases, the rotation 118 may be in either direction, but, more typically, the ride structure 116 rotates 118 in a single direction, which allows the vehicles to be provided to better simulate forward flight or movement (as may involve jumping along a circular path about center axis 116).

In ride 100, the first set 120 of vehicle support assemblies 124 may be configured to be positionable within a first or low flyer zone. For example, the low flyer zone may range from 0 to 45 degrees as measured from a horizontal plane extending through the center support structure 116 orthogonal to the axis 117 (and, typically, parallel to foundation 104), which may be thought of as angular orientation of the arm of the assembly 124. The arm of the assembly 124 may be positioned or maintained within this low flyer zone by a base angle mechanism mounted on or within the structure 116 operating to set the angular orientation of the base, which, in turn supports the support arm. Then, a passenger-controlled mechanism or assembly that is responsive to user input via a device in the vehicle may be operated to pivot or move the arm through the low flyer zone (e.g., from 0 degrees to 45 degrees (or from some other lower limit/boundary to the same or another upper limit/boundary)). In FIG. 1, all the vehicle support assemblies 124 in set 120 are shown to be operating to position the arm at a low point or minimal angular orientation of the arm (e.g., at or near 0 degrees relative to the horizontal plane passing through the structure 116).

In ride 100, the second set 140 of vehicle support assemblies 144 may be configured to be positionable within a second or high flyer zone. For example, the high flyer zone may range from 45 to 90 degrees as measured from the horizontal plane extending through the center support structure 116 orthogonal to the axis 117 (and, typically, parallel to foundation 104), which may be thought of as angular orientation of the arm of the assembly 144. As with assembly 124, the arm of the assembly 144 may be positioned or maintained within this high flyer zone by a base angle mechanism mounted on or within the structure 116 operating to set the angular orientation of the base, which, in turn supports the support arm. Then, a passenger-controlled mechanism or assembly that is responsive to user input via a device in the vehicle may be operated to pivot or move the arm through the high flyer zone (e.g., from 45 degrees to 90 degrees (or from some other lower limit/boundary to the same or another upper limit/boundary)). In FIG. 1, all the vehicle support assemblies 144 in set 140 are shown to be operating to position the arm at a high point or maximum angular orientation of the arm (e.g., at or near 90 degrees relative to the horizontal plane passing through the structure 116).

FIG. 1 is useful for illustrating the large range of motion achieved within ride 100, such as 0 to 90 degrees in this case. FIG. 1 also illustrates that the first and second sets 120, 140 each include half of the vehicle support assemblies or vehicles with set 120 including every other one of the assemblies 124 (e.g., the evens or odds) while set 140 includes the remaining or adjacent assemblies 144 (e.g., the odds or evens). FIG. 1 also illustrates that when the vehicle support assemblies 144 are operated to position vehicles in the highest (or higher) angular arm orientations (or vehicle heights) the radial distance or circular flight path diameter is at a minimum, and this causes the vehicles to be positioned relatively close together. In other words, the upper limit or boundary of the travel within the high flyer zone may be chosen based on the vehicle design and other factors to maintain spacing between two adjacent vehicles within the set of assemblies 140 at or above a minimum vehicle spacing (e.g., 0 to 36 inches or more spacing between vehicles) for safety or ride experience reasons.

Figure 2:
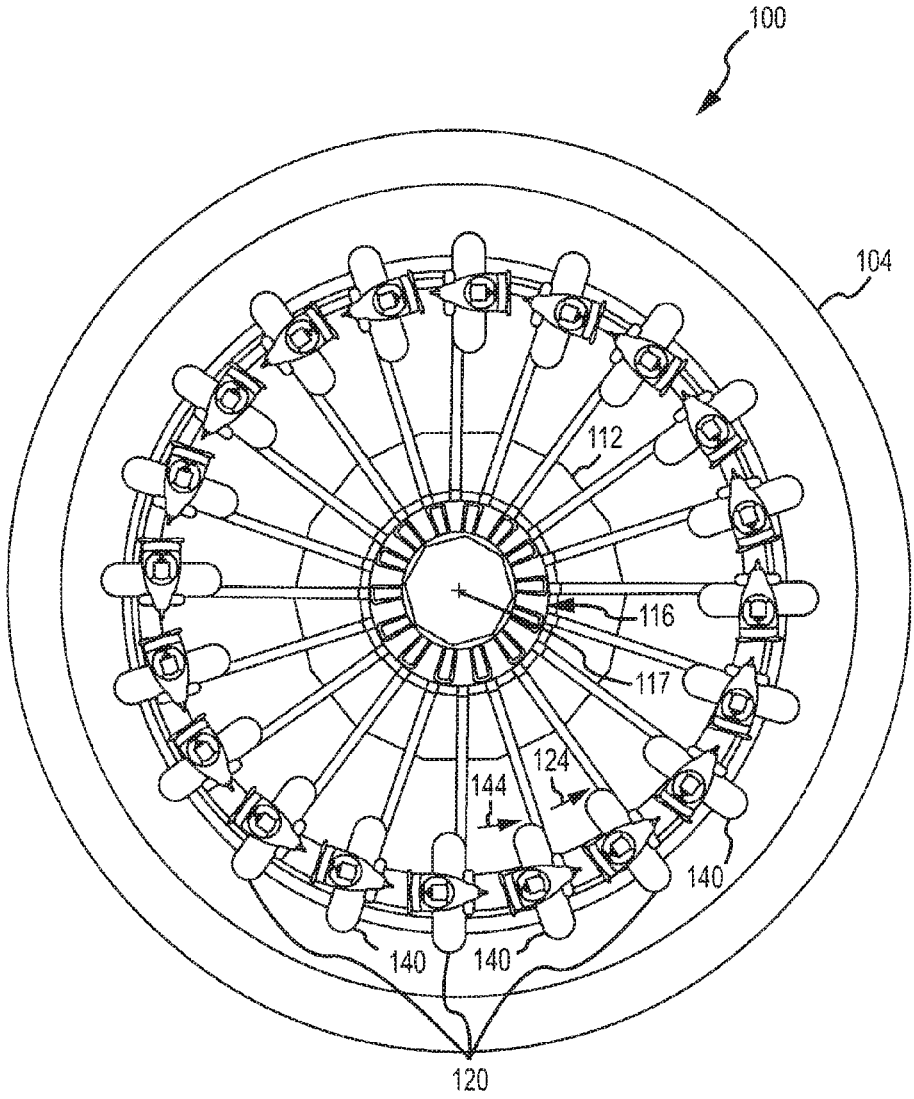
FIG. 2 is a top view of the ride of FIG. 1 with all the vehicles of the first and second sets of vehicles positioned (e.g., via operation of a ride control system to control main or support arm/boom operations) in a load/unload position (e.g., in a lowest vertical point of the low flying zone or, in many cases, a vertical position a small offset below such lowest vertical point)

FIG. 2 illustrates the ride 100 during load and unload operations. As shown, the vehicle support assemblies 144 of the second set 140 of assemblies/vehicles have been operated to move the support arm and attached vehicle from the high flyer zone to the low flyer zone and also from a maximum angular position of the arm to a minimum angular position (or load/unload position if this differs from the lower boundary of the low flyer zone). As mentioned above, the vehicle support assemblies 124, 144 may be thought of as having nested actuators with a base angle mechanism providing an actuator that may pivot a base to set the assembly into either the high or low flyer zone and with a passenger-controlled mechanism (that may be overridden by ride control system at load/unload and other times of a ride) that may pivot or rotate the arm on the base to move set the angular orientation of the arm within a particular flyer zone or workspace.

FIG. 2 is also useful for showing the vehicles of the sets 120, 140 positioned within a single flight path that coincides with one of the largest radial distances for the vehicles from the center axis 117. The circular flight path is large enough to accommodate all the vehicles arranged end-to-end (e.g., defines a maximum capacity of vehicles for the ride). The ride 100 may be operated to rotate 118 the hub 116 with the arm assemblies 124, 144 in the position shown in FIG. 2 (or with arms rotated a small distance to space vehicles apart from loading areas), and, then, either set 120 or set 140 may be operated by the ride control system to position one set of arms/vehicles into the high flyer zone. Typically, all of the assemblies within a set 120 or 140 would be concurrently moved to a new workspace or flyer zone, but this is not required to operate the ride 100 as certain ride effects may be enhanced by moving the vehicles in particular sequences. Then, the passengers may be allowed to operate the passenger-controlled mechanism to change the arm's angular orientation to adjust their vehicle's radial distance and height. For example, the passenger-controlled mechanism may be deactivated (or blocked) by the ride control system until the base has been locked into a preset position (or angular orientation) by the base angle mechanism so as to prevent vehicles interfering with each other while in the low flyer zone.

Figure 3:
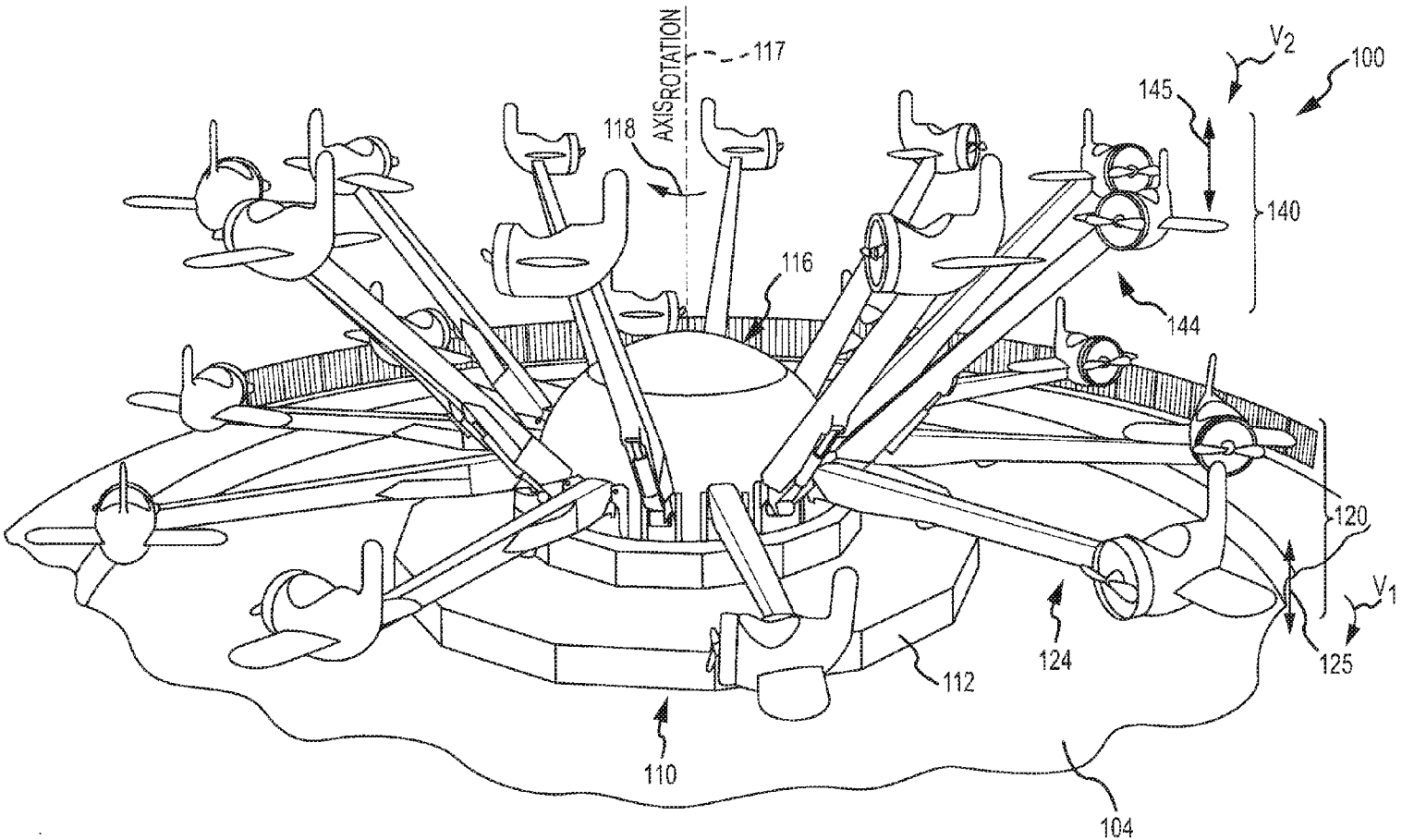
FIG. 3 illustrates another perspective view of the ride of FIGS. 1 and 2 showing the vehicles of the first and second sets of vehicles (or sets of vehicle support assemblies) in various vertical positions within the high and low flying zones (e.g., in response to user input in the vehicles to adjust vehicle height (or angular orientation of arm relative to the ground) but with each set vehicles locked (at least temporarily) within one of the two (or more) fly zones or workspaces.

FIG. 3 illustrates operation of the ride 100 at a point after load/unload shown in FIG. 2. In FIG. 3, the ride 100 has progressed to a point where the vehicle support assemblies 144 of set 140 have all been positioned to cause the arms to be operated in or pivoted through a high flyer zone while the assemblies 124 of set 120 have been maintained in or locked in the low flyer zone. The central structure 116 is being operated to rotate 118 at a particular rotation rate (e.g., 4 to 8 RPM or the like), and, as a result, each of the vehicles at the ends of the arms of assemblies 124 have a speed, $V_1$ (e.g., angular velocity) that varies with the angular orientation of the support arm within the low flyer zone (e.g., a greater velocity, $V_1$, when at lower heights or smaller arm angles due to a greater radial distance but equal rotation rate 118). The passenger (or ride control system) of a vehicle may operate a user input device to cause the arm to move up or down with the low flyer zone as shown with arrow 125 showing a changing vertical height of a vehicle. By changing the angular orientation of the support arm, the passenger is able to alter the radial distance (as well as vehicle height) to alter ride dynamics including the vehicle tangential velocity, $V_1$.

Similarly, the rotation 118 of the central structure 116 causes the vehicles in the set 140 to each have a velocity, $V_2$, that will vary with their position within the high flyer zone. Specifically, the passenger may cause their vehicle to slow down by raising the arm to a higher point in the high flyer zone and increase the vehicle speed by lowering the arm to a lower or lowest point in the high flyer zone (e.g., by increasing the radial distance between the vehicle and the center axis 117). Generally, the velocity, $V_2$, of vehicles in the high flyer zone of set 140 will be less than the velocity, $V_1$, of vehicles in the low flyer zone due to smaller radial distances provided by the greater angular orientations of support arms in set 140 compared with set 120.

As explained below, the low and high flyer zones may be defined such that there is no overlap or minimal overlap between travel paths of the vehicles in the sets 120, 140 or a midrange/overlap zone may be provided in the ride. For example, the assemblies 144 may be controlled to allow their arms to rotate between about 45 and about 90 degrees while the assemblies may be controlled to allow their arms to rotate between about 0 and 45 degrees in non-overlap embodiments/operations of ride 100. In overlap settings, though, the assemblies 144 could be allowed to have arm travel that is less than 45 degrees and/or the assemblies 124 could be allowed to have arm travel that is greater than 45 degrees (e.g., up to about 60 degrees or some other angular orientation that is small enough to avoid vehicle interference between adjacent vehicle support assemblies 124, 144 in sets 120, 140).

Figure 4:
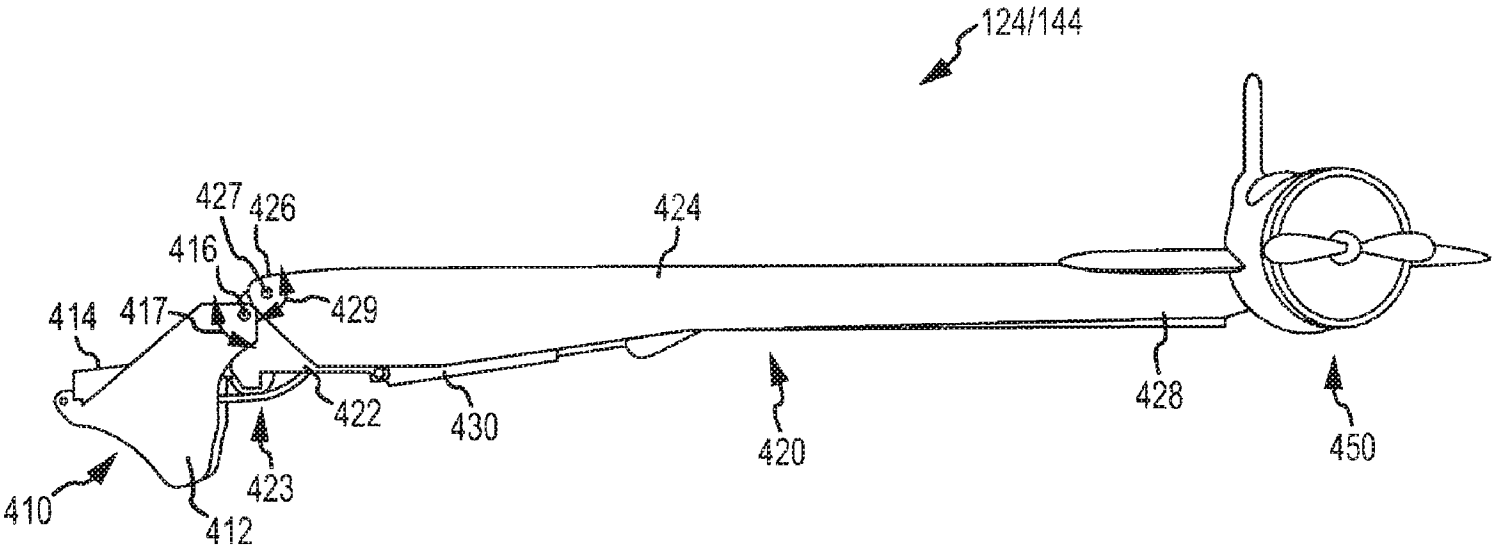
FIG. 4 illustrates a side view of an exemplary vehicle support assembly such as may be used for each of the assemblies supporting vehicles in the rides of FIGS. 1-3.

At this point, it may be useful to describe one useful configuration for a vehicle support assembly to provide the two-part positioning of round ride vehicles. FIG. 4 illustrates one implementation for such an assembly that may be used for each of the assemblies 124, 144 of the ride 100 of FIGS. 1-3 (e.g., the design of the assemblies 124 and 144 may be identical or similar). Generally, each assembly 124, 144 is made up of a base angle mechanism 410, a passenger-controlled mechanism 420, and a passenger vehicle or vehicle assembly 450. The base angle mechanism 410 and passenger-controlled mechanism 420 provide the nested actuator functions described above that position vehicle in a workspace/fly zone and also allow vehicle movement within the workspace/fly zone.

The base angle mechanism 410 includes an actuator housing or mounting frame 412, and the housing/frame 412 is rigidly mounted onto a central structure (such as structure 116) of a round ride so as to rotate with the structure. The passenger-controlled mechanism 420 includes a main or support arm 424 that is mounted at a first end 426 to a base or arm base 422. The base 422 is mounted via high/low pivot element (a shaft, pin, or the like) 416 to the actuator housing 412. The pivot element 416 defines a high/low pivot axis for pivoting (as shown with arrow 417) the base 422 between a low flyer zone and a high flyer zone. A damping or return assembly 423 may also connect the base 422 to the actuator housing 422 to cause the base to return to a low flyer position (angular orientation of base 422 relative to pivot axis extending through pivot element 416) from the high flyer position.

The base angle mechanism 410 includes a high/low pivot actuator 414 mounted on the actuator housing 412. The high/low pivot actuator 414 is positioned to have a force-applying end abutting or attached to the arm base 422 at an offset distance (lever arm) distance from the pivot element. When the actuator 414 is operated (e.g., to extend out an actuator arm/rod), the base 422 is rotated 417 from a low flyer position to a high flyer position (e.g., the base 422 may be rotated through a predefined angular rotation, such as 30 to 60 degrees with some embodiments using 45 degrees or counterclockwise rotation 417). The base 422 may then be locked into this position with a locking device (not shown in FIG. 4). When the actuator 414 is no longer operated (or a lock is released), the return assembly 423 may return the base 422 to the original or low flyer zone position via rotation 417 in the opposite direction (e.g., 45 degrees of clockwise rotation or the like). In addition to lock devices, stops may be provided to define the high and low flyer zone positions of the base 422.

Once positioned in a flyer zone or workspace by the base angle mechanism 410, the passenger-controlled mechanism 420 may operate to set the angular orientation of the main arm 424 within the workspace. The upper and lower boundaries may be defined by the travel limits of the arm 424 via operation of the passenger-controlled mechanism 420 (e.g., between 0 and 45 degrees of rotation of arm 424). The mechanism 420 includes the support arm 424 which is pivotally attached at a first end 426 to the base 422, such as via arm pivot element (e.g., a pin, shaft, or the like) 427 extending through the base 422 and arm end 426. Pivoting is shown with arrow 429 about arm pivot element 427 and is achieved with an arm pivot actuator 430 that is attached at one end to the base 422 and at a second end to the arm 424.

For example, a force-applying end of an actuator arm is affixed to arm 424 at an offset or lever arm distance from pivot element 427, which defines an arm pivot axis. Typically, the actuator 430 and its mounting are carefully designed to define a range of arm travel such as rotation 429 about arm pivot element 427 of 30 to 60 degrees such as about 45 degrees. A return assembly may also be provided to cause the arm 424 to pivot 429 from an actuator-extended position to a base or lowest position within a flyer zone or workspace (e.g., a resilient member to assist the actuator 430 in returning to a retracted position).

The arm 424 is shown to be linear with a rectangular cross section but many other configurations may be used to practice the assembly 124, 144, such as circular cross section arms with a non-linear shape (e.g., wavy, curved, or the like). The length of the arms as measured from end 426 to distal end 428 is typically 0 to 30 feet or more. A main function of the support arm 424 is to provide a rigid or relatively rigid connection between the base 422 and a vehicle or vehicle assembly 450, which is mounted to the end 428 of the arm 424.

Each vehicle 450 may be mounted with devices that maintain the body and passengers at a particular pitch and roll angle, as is known in the field of round rides. For example, the vehicle assembly 450 may be connected to the main arm 424 at end 428 through use of a rotating joint that may be either constrained to counter rotate based on arm orientation keeping the passenger level or it may allow for some amount of programmed or passenger-controlled roll motion of the vehicle 450. Counter rotation may be achieved through a mechanical linkage and/or through use of a controlled actuator. Each vehicle 450 may also include a user input device that allows a passenger to provide input/control to operate the arm pivot actuator 430, whereby the passenger is able to adjust the angular orientation of the arm 424 within a flyer zone/workspace by pivoting 429 the arm 424 about base 422 on pivot element 427.

Figure 5:
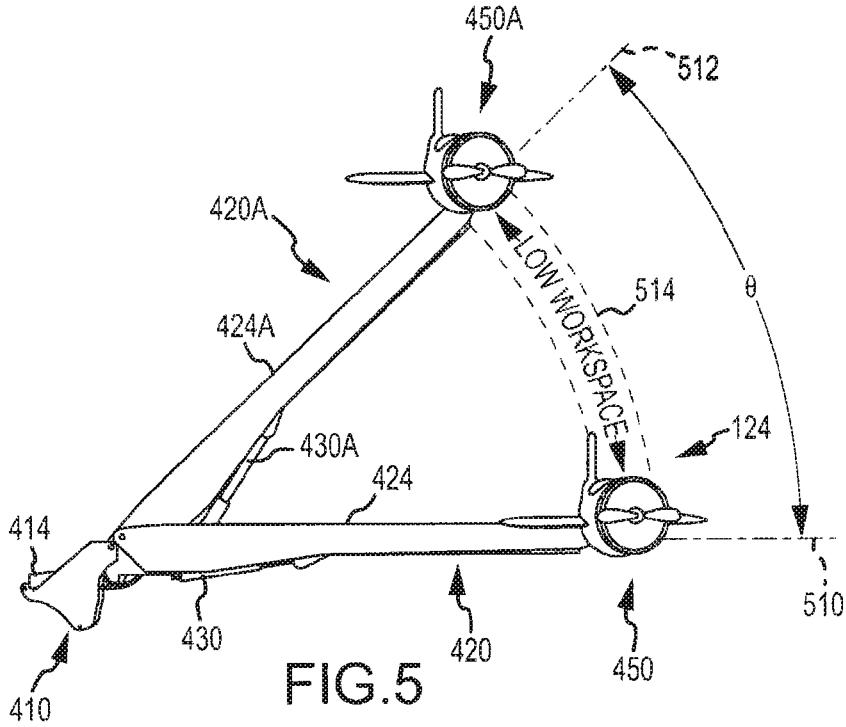

In some embodiments, the base angle mechanism 410 is configured for placing the base 422 in one of two positions so as to allow the arm 424 to be moved through two, non-overlapping workspaces or flyer zones. FIG. 5 shows the base angle mechanism 410 in a first or low position such as with the actuator 414 fully (or partially) retracted. This position may be considered a base or starting position for the mechanism 410 or a position where the base 422 is rotated 417 about the high/low pivot axis 416 to a 0 degree angular position. In this position, the arm 424 of the passenger-controlled mechanism 420 may initially be positioned with its axis parallel with an axis 510 defining a lower arm travel boundary for the arm 424 in the low workspace or low flyer zone 514.

The arm pivot actuator 430 may be operated to rotate the arm 424 through the workspace 514 by pivoting 429 the arm 424 about the arm pivot element 427. In other words, the arm 424 is swept through a low workspace sweep angle, θ, which may be any useful amount such as 30 to 60 degrees with 45 degrees being useful in some non-overlapping embodiments. FIG. 5 shows the vehicle support assembly 124 after the arm (now designated as arm 424A to indicate it is the same arm but after movement to another location) has been moved to an upper arm travel boundary for the arm 424A is parallel to or coincides with an axis 512. The movement or sweeping of arm 424A of passenger-controlled mechanism 420A may be provided by operation of arm pivot actuator 430A, and the amount of rotation (e.g., angular rotation through angle, θ) may be defined by the length of the actuator arm, the attachment points, and other factors. The movement may be responsive to user input via operation of a user device in vehicle 450 to move the vehicle 450A (e.g., to operate actuator 430, 430A) to a new position at the upper boundary 512 of the low workspace, at which point the vehicle 450A has a smaller radial distance from a central rotation axis of the ride and a greater height.

Figure 6:
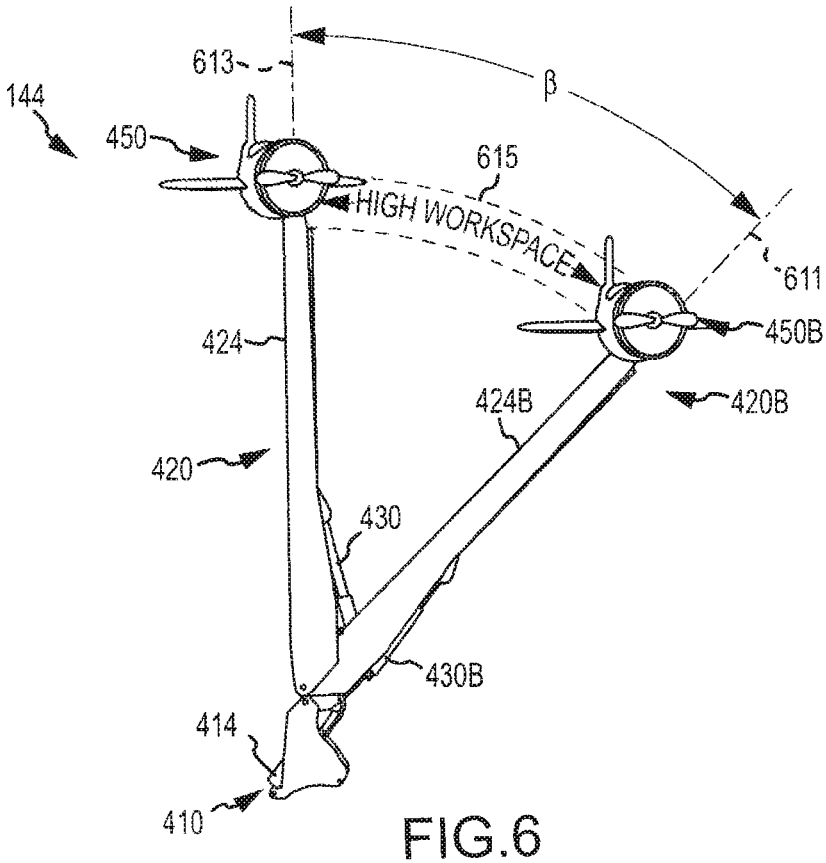
FIG. 6 shows the vehicle support assembly of FIG. 4 operating to position a vehicle in a range of vertical positions (or angular positions of a main or support arm) associated with a high workspace/high flying zone.

Similarly, FIG. 6 illustrates vehicle support assembly 144 with the base angle mechanism 410 operated to lock the base 422 in the high position such as with high/low pivot actuator 414 fully (or partially) extended to cause the base to pivot 417 about high/low pivot element 416. The amount of pivot or rotation 417 may vary to practice the invention such as between 30 and 60 degrees or more with 45 degrees from the base or starting position for the mechanism 410 or a position (e.g., the zero-degree angular position). In this case, the actuator 414 has rotated the base 422 about the high/low pivot axis 416 to a 45 degree angular position (or other useful angular position). In this position, the arm 424 of the passenger-controlled mechanism 420 may initially be positioned with its axis parallel or coinciding with an axis 613 defining an upper arm travel boundary for the arm 424 in the high workspace or high flyer zone 615.

The arm pivot actuator may be operated as shown with actuator 430B to move or sweep the vehicle support assembly 420B through the angle, β, by pivoting 429 the arm about arm pivot axis 427. For example, the arm 424B may be rotated clockwise from axis 613 up to 45 degrees or some other defining angle, β, for workspace 615 to reposition the vehicle 450B and align the arm 424B with axis 611, which coincides with the lower arm travel boundary for the arm 424B in the high workspace or high flyer zone 615.

Figure 7:
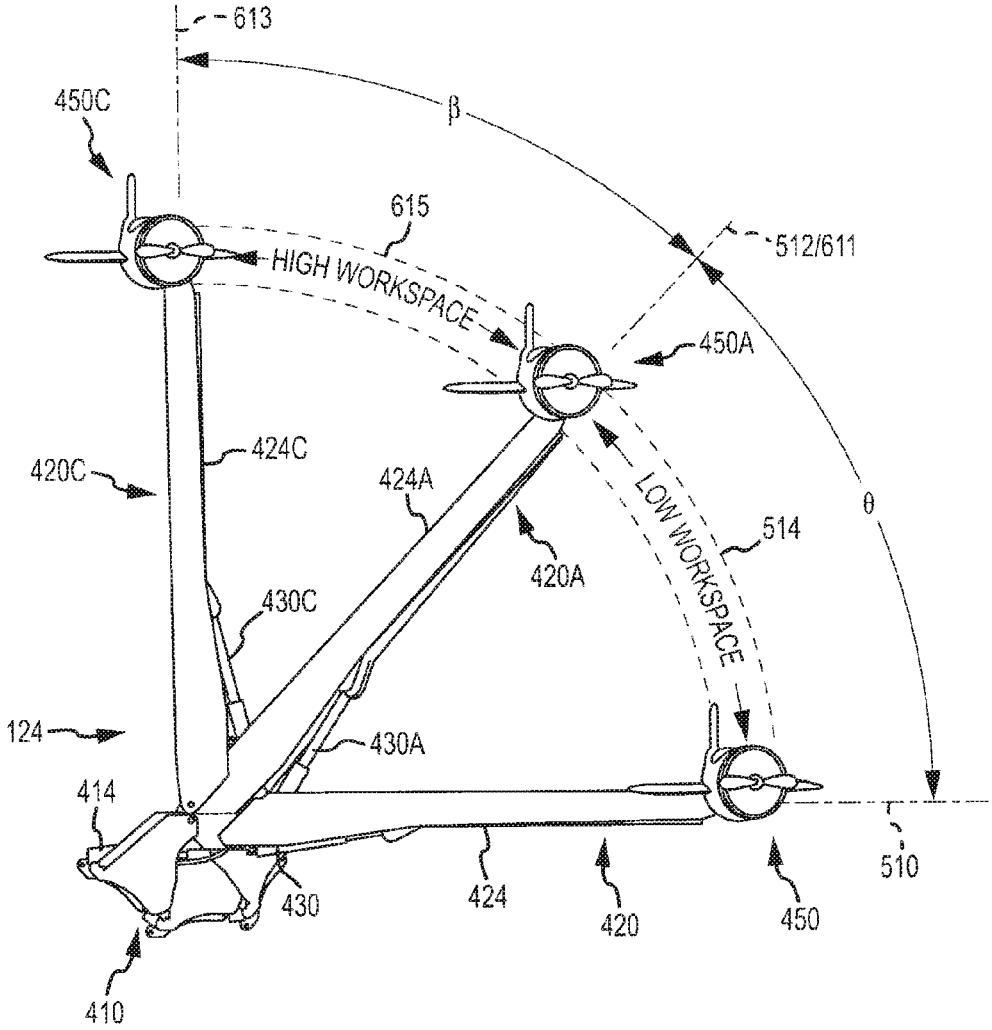
FIG. 7 shows the vehicle support assembly of FIG. 4 operating/operable in both a low and a high flying zone, which illustrates typical use of vehicle support assembly (e.g., first in either the low or high workspace and then swapping or switching to the other of the two workspaces to allow a vehicle to ride or "fly" in both workspaces for a portion of a ride cycle (or simply a time period within a ride))

FIG. 7 (with some reference to FIG. 4) illustrates use of vehicle support assembly 124 (but could also be assembly 144) in both a low workspace 514 and a high workspace 615. Typically, a ride sequence would be initiated with the base angle mechanism 410 configured (e.g., with the high/low pivot actuator 414 in a retracted or non-actuated position/condition) to place the base 422 in a first or low position (e.g., with the base 422 at a zero-degree or starting location relative to high/low pivot axis 416). The arm 424 coincides with lower arm travel boundary 510 for the low workspace 514. In this position of base 422, the arm 424 may be moved as shown at 424A to an upper arm travel boundary 512 or anywhere in between. For example, the arm 424 may be moved to arm position 454A to sweep through angle, θ, defining the size of the workspace 514.

Then, at a later time of the ride, the base angle mechanism 410 may be operated by extending the actuator 414 to pivot 417 the base 422 about high/low pivot element 416 to a second or high position. This may involve rotating the base 422 about the pivot axis extending through pivot element 416 a preset amount such as 30 to 60 degrees or 45 degrees as shown in FIG. 7. The amount of rotation of the base from the first/low position to the second/high position may be about equal to the angle, θ, defining the low workspace 514 (e.g., both be about 45 degrees), and this may be useful for providing a ride with non-overlapping workspaces 514, 615. In this second or high position of the base 422, the arm pivot actuator 430C may be operated such that the arm 424C and coupled vehicle 450C of assembly 420C are swept through the angle, β (which may equal or differ from angle, θ) between lower and upper arm travel boundaries 611, 613 of the high workspace 615. Again, such arm rotation may be provided by operation of arm pivot actuator 430C in response to user input via a user input device in vehicle 450C. As shown, the lower arm travel boundary 611 of the high workspace 615 may coincide or be the same as the upper arm travel boundary 612 of the low workspace 514 to allow overlap at this point of each workspace 514, 615 or they may be spaced apart a small amount such as a few degrees to provide no overlap of the workspaces to provide a clear line of sight for vehicle in position 450A.

Generally, the user is able to control vehicle position, and the vehicle position may be continuously variable within the workspaces 514, 615, with the position being dependent upon the position of the arm pivot actuator 430 (or its operation). The vehicle workspace, i.e., low 514 or high 615, is defined by a position of a high/low pivot actuator 414 of the base angle mechanism 410, and, typically, there are two positions for the actuator 414, with a lock provided in some embodiments. Hence, in one embodiment of the invention, the base angle mechanism 410 is used to create two, non-overlapping regions or workspaces 514, 615. In this embodiment, the passenger-controlled mechanism 420 may include a hydraulic cylinder, linear electric actuator, or other actuator 430 that is controlled directly by the passenger of the vehicle 450. The base angle mechanism 410 may also include a hydraulically or electrically actuated pivot device 414 that can be actuated to and locked in either one of two end positions. The actuators 414, 430 may be hydraulic, electric, magnetic, and/or pneumatic actuators that may be angle limited by mechanical and/or electrical components.

The base angle mechanism is ride controlled, which may be achieved using software elements (e.g., computer readable code devices or code in computer readable medium that causes one or more hardware processors or hardware to perform one or more functions) in a supervisory computer or controller that monitors and modifies the arm angle range. The vehicle support arm is connected to the base structure, and the base angle mechanism is capable of moving the base between two or multiple parked positions so as to define separate/independent workspaces (that may or may not overlap to suit an application) for vehicle motion.

Figure 8:
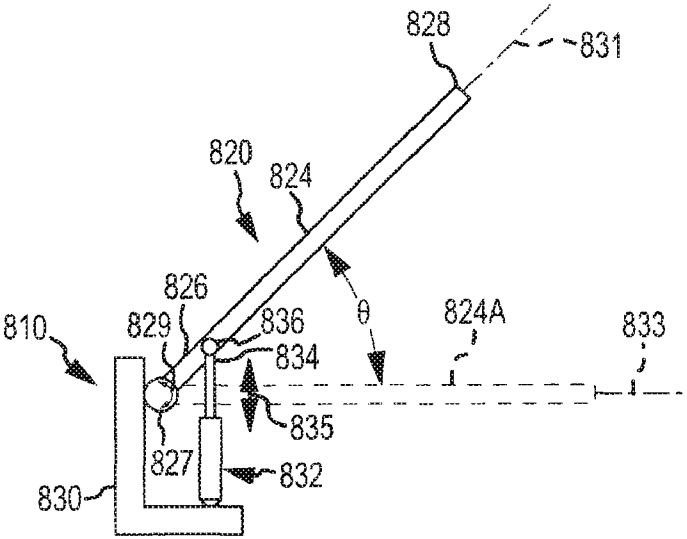
FIG. 8 shows a simplified schematic of a passenger-controlled mechanism used to rotate a main arm through a range of angular positions (e.g., to define the angular orientation of the main arm and to set the vertical height of the vehicle within a workspace or fly zone)

FIG. 8 illustrates a portion of a vehicle support assembly 810. Specifically, the assembly 810 is shown in schematic form to include a passenger-controlled mechanism 820. The mechanism 820 includes a vehicle support arm 824 that extends from a first end 826 to a second end 828 (to which a vehicle (not shown) would be attached). The arm 824 is pivotally coupled (as shown with arrow 829) to a base structure 830 via arm pivot element 827. Pivoting 829 is controlled by operation of an arm pivot actuator 832 that selectively extends/retracts 835 an actuator arm 834, and the actuator 832 is attached at a first end to base structure 830 and pivotally attached via connector 836 to the arm 824 at an offset distance from arm pivot element 827. With the actuator arm 834 extended, the arm 824 is positioned at an upper arm travel boundary 831 of a workspace, and when the actuator arm 834 is retracted, the arm is positioned to coincide with a lower arm travel boundary 833 of a workspace as shown by dashed arm 824A. The workspace may be defined, in part, by the magnitude of the angle, θ, between the boundaries 831, 833, which may be 45 degrees or some other useful angle to practice the invention.

Figure 9:
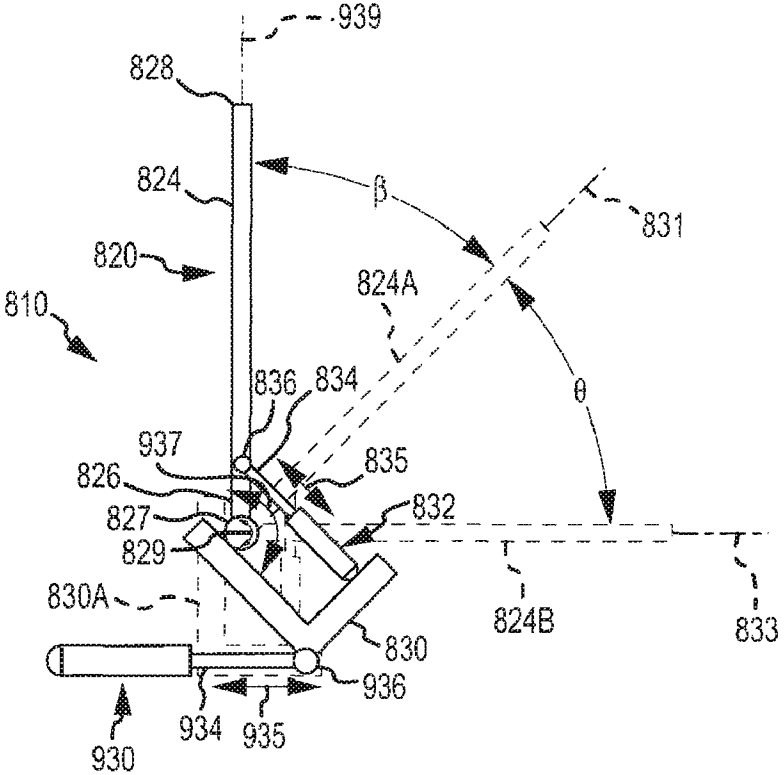
FIG. 9 shows a simplified schematic of a vehicle support assembly that includes the passenger-controlled mechanism and further includes a base angle mechanism controlled by a ride control system (not shown in FIG. 9) that is used to lock a support arm within one of two or more workspace or fly zones by, in this example, rotating the passenger-controlled mechanism (e.g., the base or rotation point of the main arm) itself to a new angular location (e.g., rotate the passenger-controlled mechanism 45 degrees counterclockwise to move it to a high flying zone (high workspace) or 45 degrees clockwise to move it to a low flying zone (low workspace) from the high flying zone)

FIG. 9 illustrates the vehicle support assembly 810 that further includes a base angle mechanism 930. The base angle mechanism 930 includes an actuator 934 that may be extended/retracted 935 to cause end 936 to be moved between 2 positions (extended and retracted). The end element 936 pivotally links or connects the actuator arm 934 to the base structure 830 such that when the actuator 934 is retracted, the base structure is in a first or low position (e.g., zero-degree rotation position for arm pivot element 827 coupled to base structure 830) as shown with dashed base 830A. When the actuator 934 is extended outward 935, the base 830 is moved to a second or high position, which causes the arm pivot element 827 to be rotated 829 to cause the arm 824 to move into a new workspace (e.g., to a high workspace).

As shown, with the base 830 in the high position, the arm 824 is positionable 937 at any angular orientation between an upper arm travel boundary 939 and a lower arm travel boundary 831 for the high workspace defined by angle, β, between arm 824 and dashed arm 824A (or axes 939 and 831) (e.g., a range of possible arm positions when mechanism 930 has its arm 934 extended to rotate the base 830 (and interconnected pivot point/axis 827) about 45 degrees). Also, as shown, with the base 830A is in the low position (unrotated or initial position), the arm is positionable 937 at any angular orientation between an upper arm travel boundary 831 of the low flyer zone or low workspace and a lower arm travel boundary 833 of the low workspace. The arms 824A and 824B show the vehicle support arm at the boundary or outermost travel points in their sweep through the angle, θ, which defines the low flyer zone or low workspace coinciding with a base position shown for base structure 830A.

Figure 10:
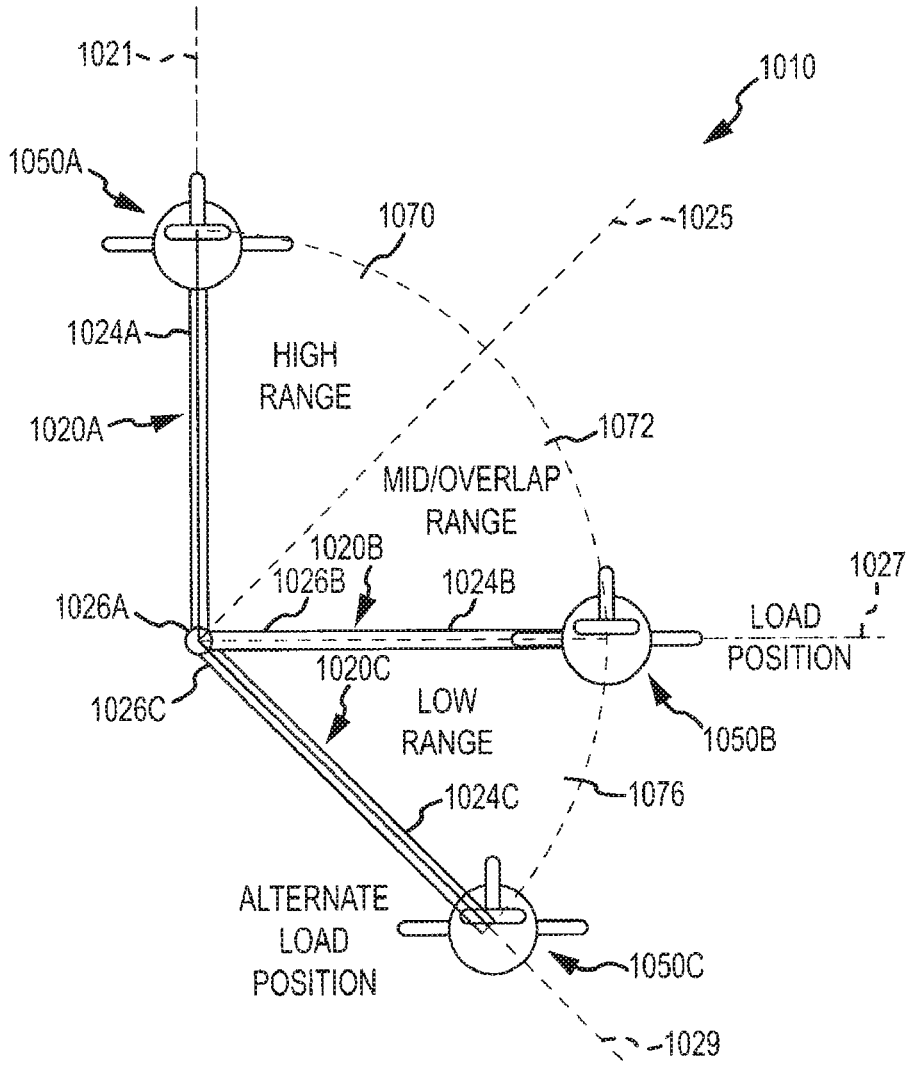
FIG. 10 illustrates a schematic of another high-low flyer ride system in which each of the vehicle support assemblies is operable in a high or low range, with a portion of the two ranges overlapping (e.g., the highest point of the low range is within the high range and the lowest point of the high range is within the low range) and with the highest point of the low range being defined to be at or below a point at which interference between vehicles will occur (e.g., a largest arm angle that defines a circle at the ends of the arms in which all vehicles will fit, which will vary with vehicle body design such as vehicle length)

In other embodiments, it may be desirable to provide two workspaces that overlap to increase rider and/or vehicle interaction. FIG. 10 illustrates a ride 1010 that may include a plurality of vehicle support assemblies extending about a rotating central structure as explained above. Each vehicle support assembly includes a base angle mechanism (not shown in FIG. 10) that is used to position a passenger-controlled assembly 1020 in one of two main positions (e.g., two workspaces). The assemblies may take the form shown in FIG. 10 (with the A, B, and C designations illustrating differing positions of the assembly 1020 or its arm 1024).

As shown, the ride 1010 may be configured with a high range workspace 1070 and a low range workspace 1076. However, the ride 1010 may be configured to allow these two workspaces 1070, 1076 to overlap in a mid range workspace or overlap zone 1072. Specifically, the assembly 1020 may be placed with its base in a high position by a base angle mechanism. In this position, as shown, the assembly 1020A may have a first end 1026A attached to an arm pivot element that is pivotally supported by the base, and a second end supporting a vehicle 1050A, and the arm 1024A may coincide with an upper arm travel boundary associated with axis 1021. The assembly 1020 may be operated (e.g., via a rider controlling an arm pivot actuator) to sweep through the high range workspace which may include both the high range 1070 and the mid range/overlap range 1072 (e.g., the angular sweep may be about 90 degrees as shown).

Assembly 1020B shows the repositioning of the arm 1024B to coincide with axis 1027 or the lower arm travel boundary for the high range workspace 1070 (and for the mid/overlap range workspace 1072). This is achieved by operating an arm pivot actuator (not shown) to rotate the end 1026B about an arm pivot element on the base structure and position the vehicle 1050B at a lower elevation (horizontal in this example, which may be a load position) and a greater radial distance. Assembly 1024C is used to show the vehicle support assembly when the base structure is rotated to a low position such that the arm 1024C may rotate about end 1026C such that the vehicle 1050C is at an even lower position which may be an alternate load position. The arm 1024C may be at the lower arm travel boundary of the low range workspace (which may coincide with axis 1029), e.g., coinciding with axis 1029.

As illustrated, the low range workspace may include the low range 1076 and the mid/overlap range 1072 such that the arm 1024 and vehicle 1050 may travel to any angular orientation between boundaries/axes 1025 and 1029. The high range 1070 and low range 1076 may be flyer zones or workspaces where only vehicles of one of the two sets of vehicle support assemblies would be positioned while mid or overlap range 1072 may be a flyer zone or workspace in which all vehicles may be positioned. In such an embodiment, the passenger-controlled mechanism is designed to provide about an angular range of movement of about 90 degrees, and the base angle mechanism would act to rotate the base about 45 degrees (e.g., to move the lower arm travel boundary from axis 1029 to axis 1027 when moving from low to high positions of the base). The axis 1025 or upper boundary of the mid or overlap range 1072 may be the largest arm angle (or radial distance from a central axis) that can be used and fit all vehicles into a circular flight path (e.g., not incur any contact/interference between adjacent vehicles).

FIG. 10 shows that the combined use of a base angle mechanism and a passenger-controlled mechanism for each vehicle support assembly allows a ride to be achieved with multiple separate ranges or zones defined. While assigned to a specific range, the vehicle may be moved within the range under passenger control. The ride system may coordinate moving vehicles from one range into another during the ride experience so that all passengers can experience the different ride dynamics or show elements present in the separate ranges. The ride control system, in some embodiments, manages vehicle motion between ranges by rotating the base via the base angle mechanism to ensure safety and to maintain or achieve a desired spacing of adjacent vehicles (e.g., move half of the vehicles to the high range while retaining the other half in the low range and then later swapping the two sets of alternating vehicles to the other range).

At this point in the description, it may be useful to describe a typical or basic ride sequence that may be followed in a two-zone embodiment. FIGS. 11A to 14A and FIGS. 11B to 14B illustrate top and side views, respectively, of a high and low flyer round ride 1100 configured to increase capacity by providing two flyer zones (low and high). The ride 1100 includes a central support structure/hub 1116 that rotates 1118 about a center or rotation axis 1117, and a first set of vehicle support assemblies 1120 (e.g., that support the "odd" numbered vehicles if counting each vehicle about the hub 1116) and a second set of vehicle support assemblies 1140 (e.g., that support the "even" numbered vehicles or the vehicles that alternate with the vehicles of set 1120). As described earlier, a ride control system is provided in ride 1100 to selectively operate a base angle mechanism to allow or disallow subsets of vehicles/vehicle support assemblies (such as half at a time) from being in a high zone, which may have smaller radial distances that could lead to vehicle interference if all vehicles were allowed to move up into this zone. The base angle mechanism achieves this control, typically, by rotating or pivoting a base of every other vehicle support assembly from a low to a high position such that half of the vehicles are placed in the second or high flyer zone.

Figure 11A:
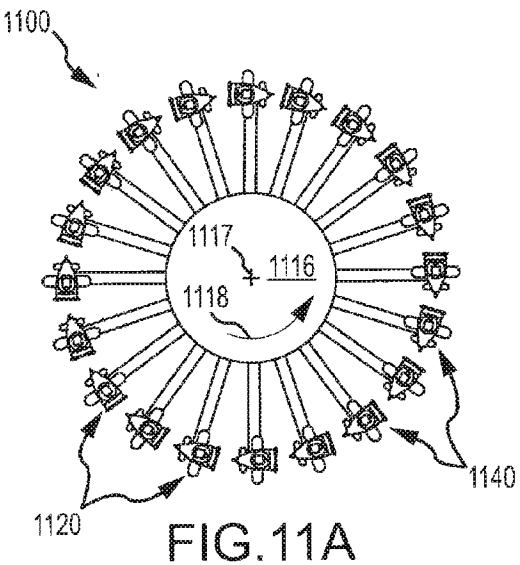
Figure 11B:
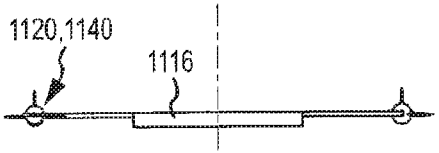

The high low flyer ride sequence may begin (and later end) as shown in FIGS. 11A and 11B with vehicle loading and unloading. Typically, all vehicles would be loaded and unloaded simultaneously, and, at this step in the sequence, the base angle mechanism is operated to place the arm base in a first or low position, and the ride control system may be operated to block user operation of arm pivot actuators. As a result, as shown, all vehicles of assemblies 1120, 1140 are at ground level or a low load/unload position. In this step, the rotation velocity 1118 is likely zero, and passengers can safely enter and exit the vehicles of the assemblies 1120.

At dispatch, the hub 1116 may begin to rotate 1118 about axis 1117 at velocities greater than zero such as up to about 8 RPM or the like. More significantly, though, the dispatch portion of the sequence may include the base angle mechanism operating to place a set of vehicle support assemblies into the second or high position. For example, the assemblies 1120 may be maintained in the first or low flyer zone with their arm bases in the first or low position (e.g., zero degrees of rotation). However, the assemblies 1140 may be moved by the base angle mechanism into the second or high flyer zone with their arm bases each rotated/pivoted into the second or high position (e.g., 45 degrees of rotation of the base). This may involve the high-low actuator moving the base about a base pivot element to move adjacent vehicles into separate workspaces.

Figure 12A:
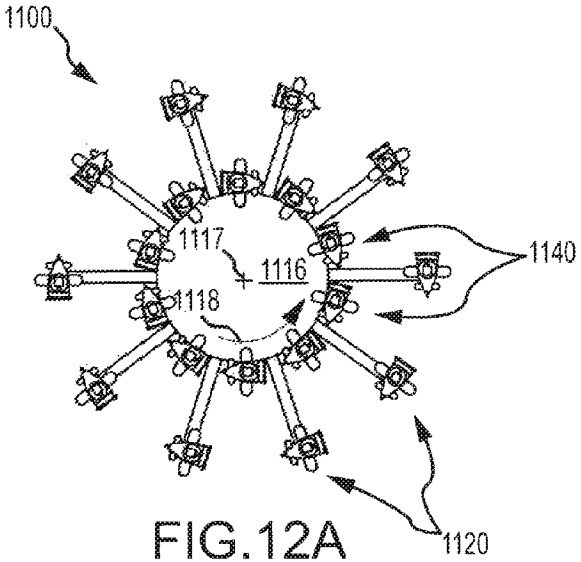
FIGS. 11A-14B shows top and side views of a high and low flying round ride illustrating an exemplary ride sequence.
Figure 12B:
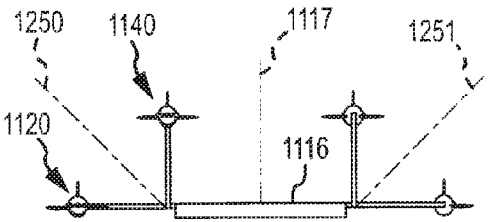

FIGS. 12A and 12B are useful for showing the ride 1100 after initial dispatch is completed. As shown, the arms and attached vehicles of the vehicle support assemblies 1120 (or of the first set of assemblies/vehicles) are limited to travel within a low flyer zone that ranges from a horizontal plane (or 0 degrees) to an upper arm travel boundary shown by axes 1250, 1251 (e.g., about 45 degrees). Such travel of the arms of assemblies 1120 may be passenger controlled and/or may be set (based on a ride profile, for example) by a ride control system through operation of an arm pivot actuator connected to the base (which is in the low or first position). The arms and attached vehicles of the vehicle support assemblies 1140 (or of the second set of assemblies/vehicles) are limited to travel within a high flyer zone that ranges from a vertical plane (or about 90 degrees from the horizontal plane) to the lower atm travel boundaries 1250, 1251 (or about 45 degrees from the horizontal plane).

FIGS. 12A and 12B show the assemblies 1120, 1140 at the extremes (high and low) of their travel ranges to illustrate the wide range of travel that is achieved with the design of ride 1100, which provides a wide variance in ride dynamics (e.g., angular velocities at the same rotation rate 1118 by hub 1116 about axis 1117) and lines of sight in ride 1100. Hence, after dispatch, the sequence may be thought of as including a time period or step where vehicles of assemblies 1120 are in the low flyer zone, vehicles of assemblies 1140 are in the high flyer zone (vehicles in separate workspaces—that may be non-overlapping or may overlap over some shared range of arm travel), and passengers may be able to interactively control vehicle position within each flyer zone (e.g., by operating a vehicle input device to directly operate/control an arm pivot actuator or similar arm-pivoting device).

Figure 13A:
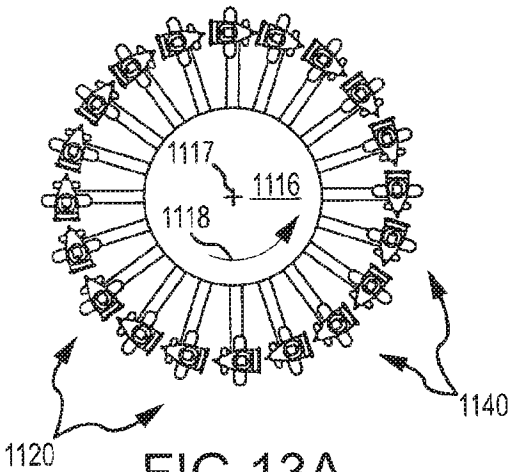
Figure 13B:
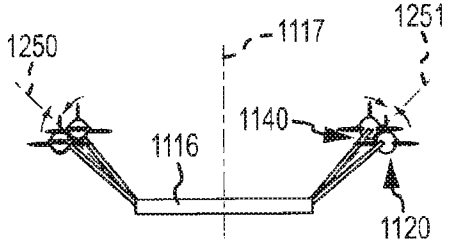

In a swap step or portion of the sequence of operating ride 1100, the ride control system may move/swap vehicles between the two workspaces. This allows all passengers to experience the full range of system motion and dynamics as well as providing a fun and exciting "passing" situation as the vehicles pass through a transition or overlap region. FIGS. 13A and 13B illustrate the ride 1100 as the vehicles of vehicle support assemblies (or the first set) 1120 are being moved upward 1309 into the high flyer zone and the vehicles of vehicle support assemblies (or the second set) 1140 are being moved downward 1307 into the low flyer zone. The vehicles of the assemblies 1120, 1140 are shown to be overlapping in their travel paths (e.g., their heights and radial distances from the center rotation axis 1117 of hub 1116) during this portion of the swap step.

Figure 14A:
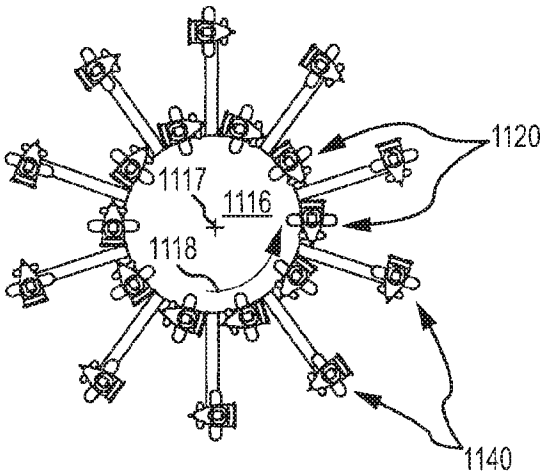
Figure 14B:
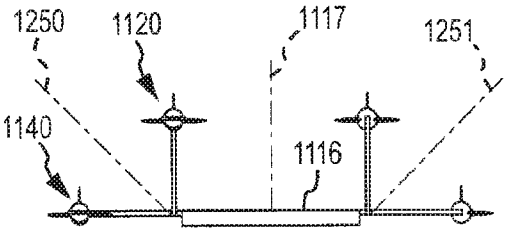

The swapping is performed by the ride control system operating the base angle mechanisms to pivot the bases of the assemblies 1120 upward (e.g., by 45 degrees to a 45 degree or high position) and the bases of the assemblies 1140 downward (e.g., by 45 degrees to a zero degree or low position). FIGS. 14A and 14B illustrate the ride at a time in the operating sequence after the swapping step is complete. As shown, the vehicles of assemblies 1120 can be positioned at a range of positions (heights and radial distances) via moving the arm to a range of angular orientations within the high flyer zone while the vehicles of assemblies 1140 can now be positioned at various positions within the low flyer zone. The ride sequence would then end by returning (via operation of the ride control system and base angle mechanisms) the vehicles to the low flyer zone and arms to a lowered position for unloading and then loading for a new ride sequence.

Figure 15:
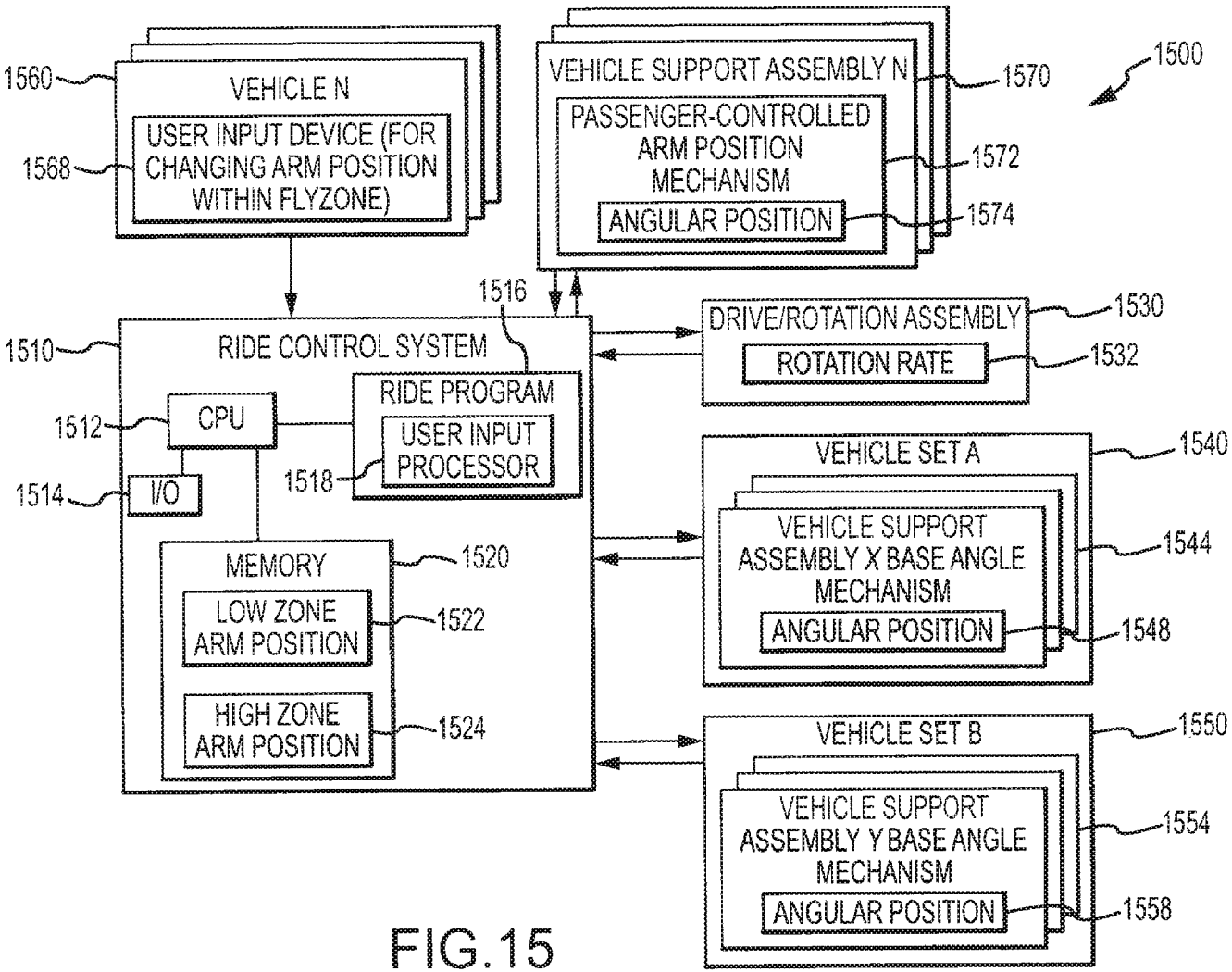
FIG. 15 illustrates with a functional block diagram a high-low flyer ride system showing interaction of a ride control system with system components to control vehicle positioning within two (or more) workspaces.

FIG. 15 illustrates a high-low flyer ride 1500 in functional block form to facilitate description of how a ride and its components may be controlled and operated. The ride 1500 is shown to include a ride control system 1510 (e.g., a computer or electronic device using a combination of hardware and software to perform ride control functions such as to implement the ride sequence described above) that may include a hardware processor(s) 1512 that manages operation of input/output devices 1514 and memory/data storage 1520 (e.g., computer readable media, digital data storage devices, and the like). The I/O devices 1514 may include keyboards, mice, touchscreens/touchpads, monitors, printers, and the like that allow an operator of the control system 1510 to input data/commands and to view ride data such as operating status of the ride including angular orientations of the various vehicles support assemblies (their arm bases and/or their vehicle support arms). For example, an operator may initiate a ride program 1516 that may define ride profiles that determine when vehicle assignments to workspaces or flyer zones may occur, when swaps between zones may occur, rotation rates, and so on.

The ride program 1516 typically is a software program/application (e.g., code devices) that causes the processor 1512 or other portions of control system 1510 to perform the functions described herein such as transmitting control signals to operate a central drive assembly or hub, to operate vehicle support assemblies by rotating the bases with base angle mechanisms and so on. The ride program 1516 may include a user input processor routine 1518 that processes user input to then generate control signals to operate an arm pivot actuator mechanism (or such control may be more direct in some cases). The memory 1520 may store ride profiles as well as ride programs 1516, and the memory 1520 also typically stores low and high zone arm positions (or base angle rotation positions) 1522, 1524 that are used by ride program 1516 to generate control signals to vehicle support assemblies (e.g., to rotate half of the bases to the high position).

The ride 1500 includes a drive/rotation assembly 1530 such as the central support structures described above in the ride systems of FIGS. 1-14B. The drive assembly 1530 supports vehicle support assemblies of the ride 1500 (e.g., the housing or frame for the high/low pivot actuators typically is mounted to the hub of the drive assembly 1530) such that these assemblies and attached vehicles rotate with the drive assembly 1530. The drive assembly is operated by the ride control system 1510, such as based on the ride program 1516, to rotate at one or more rotation rates 1532 about a rotation axis.

The ride 1500 also includes a first vehicle set 1540 and a second vehicle set 1550 (which are each associated with first and second sets of vehicle support assemblies). The ride control system 1510 runs the ride program 1516 to determine, such as based on preset low and high zone arm/base positions 1522, 1524, when to signal base angle mechanisms 1544, 1554 of each vehicle set 1540, 1550 to adjust the angular positions 1548, 1558 of their bases (arm base components that support the arm pivot actuators). In response to high zone assignment commands, the base angle mechanisms 1544 or 1554 of one set of the vehicles 1540, 1550 function to position the bases in the high position to allow the corresponding arms/vehicles to operate in a high flyer zone while the other Mechanisms 1544 or 1554 are kept locked in the low position to keep its arms/vehicles operating in a low flyer zone. If swapping is occurring, these bases are moved from the high to the low position based on commands from control system 1510.

The ride 1500 also includes vehicles 1560 at the ends of vehicle support arms, and these vehicles 1560 are shown to include user input devices such as joysticks, levers, switches, and so on for changing/setting angular arm position (e.g., raise vehicle up or down within a particular flyer zone). These signals may be passed to the ride control system or directly to passenger-controlled arm position mechanisms 1572. In some cases, the user input processor 1518 may process these user input signals/data to determine when and what control signals to transmit to vehicle support assemblies 1570. Particularly, signals are sent to the passenger-controlled arm position mechanisms 1572 to set angular positions 1574 (e.g., control signals used to selectively operate an arm pivot actuator to pivot an end of the arm on its base (which, in turn, may be pivoted by the base angle mechanism to place the arm within a workspace/flyer zone)). The angular position 1574 may also be controlled in some cases to suit a ride program 1516 such as during load/unload or during particular ride features (e.g., move all vehicles in high flyer zone to the very top of the arm travel for a time period or the like).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A round ride, comprising:

a drive assembly including a structure rotatable about a central axis; and a plurality of vehicle support assemblies mounted to the rotatable structure, wherein each of the vehicle support assemblies comprises:

a passenger vehicle;

a vehicle support arm supporting the passenger vehicle proximate a first end;

an actuator assembly, wherein a second end distal to the first end of the vehicle support arm is mounted to the actuator assembly;

a base, wherein the actuator assembly is mounted onto the base; and a base angle mechanism mounted to the rotatable structure and operable to position the base into one of a low position and a high position, wherein each of the base angle mechanisms includes a housing affixed to the rotatable structure, wherein each of the bases is pivotally attached to the corresponding housing of the base angle mechanism, and wherein each of the base angle mechanisms includes a high-low pivot actuator attached at a first end to the housing and at a second end to the base to pivot the base to the high position when the actuator is extended.

2. The round ride of claim 1, wherein the vehicle support assemblies are grouped into first and second sets including alternating ones of the vehicle support assemblies and wherein the base angle mechanisms are operated to position the first set of vehicle support assemblies in the low position and the second set of vehicle support assemblies in the high position.

3. The round ride of claim 1, wherein in each of the vehicle support assemblies the second end of the vehicle support arm is pivotally mounted to the base and wherein each of the vehicle support assemblies further comprises a passenger-controlled mechanism operable in response to passenger operation of an input device associated with the passenger vehicle to pivot the vehicle support arm through an angular range of motion.

4. The round ride of claim 3, wherein the angular ranges of motion of the vehicle support assemblies in the low position are at least partially non-overlapping with the angular ranges of motion of the vehicle support assemblies in the high position, whereby the passenger vehicles in the high position have clearance from adjacent ones of the passenger vehicles in the low position.

5. The round ride of claim 3, wherein the angular ranges of motion sweep the vehicle support arm through an angle of about 45 degrees.

6. The round ride of claim 1, wherein the base is moved between the low and high positions by the base angle mechanism pivoting the base about a high-low pivot element through an angle of rotation selected from the range of about 30 to about 60 degrees.

7. The round ride of claim 6, wherein the base angle mechanisms are operated concurrently to move a first half of the vehicle support assemblies from the high position to the low position and to move a second half of the vehicle support assemblies from the low position to the high position, whereby adjacent ones of the passenger vehicles temporarily have equal angular orientations defined by the vehicle support arms relative to a horizontal plane.

8. A method for operating a round ride including a plurality of vehicle support assemblies extending from a rotatable central hub, comprising:

with a controller, first positioning all of the vehicle support assemblies in a low flyer zone, wherein the first positioning includes operating a base angle mechanism to pivot a base of each of the vehicle support assemblies into a low position;

rotating the central hub about a central axis at a rotation rate; and with the controller, second positioning alternating ones of the vehicle support assemblies into a high flyer zone, wherein the second positioning includes operating the base angle mechanism to pivot the base of each of the alternating ones of the vehicle support assemblies from the low position to a high position at a predefined angular offset, wherein each of the vehicle support assemblies includes an arm supporting a passenger vehicle, wherein in each of the vehicle support assemblies the arm is pivotally mounted to the base, and wherein each of the vehicle support assemblies includes an arm pivot actuator operable to pivot the arm relative to the base through an angular range of motion, whereby the passenger vehicles are positionable in ranges of radial and vertical positions in the lower flyer zone that differ from rang of radial and vertical positions in the higher flyer zones.

9. The method of claim 8, wherein the angular offset is at least about 45 degrees.

10. The method of claim 8, further comprising, after the second positioning, third positioning the vehicle support assemblies positioned during the second positioning step in the high flyer zone into the low flyer zone and the vehicle support assemblies positioned in the low flyer zone into the high flyer zone.

11. The method of claim 8, wherein the angular range of motion of the arms of the vehicle support assemblies in the low position and the angular range of motion of the arms of the vehicle support assemblies in the high position are defined such that the low and high flyer zones have a region of overlap.

12. The method of claim 11, wherein the angular range of motion of the arms is at least about 45 degrees and wherein the arm pivot actuator operates in response to passenger input.

13. A round ride, comprising:

a drive assembly including a hub rotatable about a central axis;

a first set of vehicles mounted to support arms pivotally coupled to the hub;

a second set of vehicles mounted to support arms coupled to the hub and each positioned between adjacent pairs of the support arms of the first set; and a ride control system independently positioning the arms of the first and second sets of vehicles in one of at least two workspaces, wherein each of the support arms is pivotally mounted to a base, wherein each of the support arms is pivoted through operation of an arm pivot actuator connected to the base and the support arm to move the support arm through the one of the workspaces, wherein each of the bases is pivotally mounted to the hub with a high-low pivot actuator abutting the base, and wherein the ride control system operates the high-low pivot actuators to perform the positioning of the arms of the first and second sets of vehicles into the workspaces.

14. The round ride of claim 13, wherein the workspaces define a range of angular movement of the support arms relative to a coupling to the hub.

15. The round ride of claim 14, wherein the workspaces include a high flyer zone and a low flyer zone and wherein the ranges of angular movement of support arms in the high flyer zone and in low flyer zone overlap.

16. The round ride of claim 13, wherein the ride control system further operates to concurrently reposition the arms of the first and second sets of vehicles in other ones of the at least two workspaces.

17. A round ride, comprising:

a drive assembly including a structure rotatable about a central axis; and a plurality of vehicle support assemblies mounted to the rotatable structure, wherein each of the vehicle support assemblies comprises:

a passenger vehicle;

a vehicle support arm supporting the passenger vehicle proximate a first end;

an actuator assembly, wherein a second end distal to the first end of the vehicle support arm is mounted to the actuator assembly;

a base, wherein the actuator assembly is mounted onto the base; and a base angle mechanism mounted to the rotatable structure and operable to position the base into one of a low position and a high position, wherein at least a subset of the base angle mechanisms includes a high-low pivot actuator attached to the base and selectively operating to pivot the base between the low and high positions when the actuator is operated.

18. The round ride of claim 17, wherein the vehicle support assemblies are grouped into first and second sets including alternating ones of the vehicle support assemblies and wherein the base angle mechanisms are operated to position the first set of vehicle support assemblies in the low position and the second set of vehicle support assemblies in the high position.

19. The round ride of claim 17, wherein in each of the vehicle support assemblies the second end of the vehicle support arm is pivotally mounted to the base and wherein each of the vehicle support assemblies further comprises a passenger-controlled mechanism operable in response to passenger operation of an input device associated with the passenger vehicle to pivot the vehicle support arm through an angular range of motion.

20. The round ride of claim 19, wherein the angular ranges of motion of the vehicle support assemblies in the low position are at least partially non-overlapping with the angular ranges of motion of the vehicle support assemblies in the high position, whereby the passenger vehicles in the high position have clearance from adjacent ones of the passenger vehicles in the low position.

21. The round ride of claim 19, wherein the angular ranges of motion sweep the vehicle support arm through an angle of about 45 degrees.

22. The round ride of claim 17, wherein the base is moved between the low and high positions by the base angle mechanism pivoting the base about a high-low pivot element through an angle of rotation selected from the range of about 30 to about 60 degrees.

23. The round ride of claim 22, wherein the base angle mechanisms are operated concurrently to move a first half of the vehicle support assemblies from the high position to the low position and to move a second half of the vehicle support assemblies from the low position to the high position, whereby adjacent ones of the passenger vehicles temporarily have equal angular orientations defined by the vehicle support arms relative to a horizontal plane.

* * * * *

UNITED STATES PATENT AND TRADEMARK OFFICE

CERTIFICATE OF CORRECTION

PATENT NO. : 8,317,632 B2
APPLICATION NO. : 12/877243
DATED : November 27, 2012
INVENTOR(S) : Edward A. Nemeth and David W. Crawford It is certified that error appears in the above-identified patent and that said Letters Patent is hereby corrected as shown below:

Column 19, replace claim 8 with the following re-written claim:

--A method for operating a round ride including a plurality of vehicle support assemblies extending from a rotatable central hub, comprising:

with a controller, first positioning all of the vehicle support assemblies in a low flyer zone, wherein the first positioning includes operating a base angle mechanism to pivot a base of each of the vehicle support assemblies into a low position;

rotating the central hub about a central axis at a rotation rate; and with the controller, second positioning alternating ones of the vehicle support assemblies into a high flyer zone, wherein the second positioning includes operating the base angle mechanism to pivot the base of each of the alternating ones of the vehicle support assemblies from the low position to a high position at a predefined angular offset, wherein each of the vehicle support assemblies includes an arm supporting a passenger vehicle, wherein in each of the vehicle support assemblies the arm is pivotally mounted to the base, and wherein each of the vehicle support assemblies includes an arm pivot actuator operable to pivot the arm relative to the base through an angular range of motion, whereby the passenger vehicles are positionable in ranges of radial and vertical positions in the lower flyer zone that differ from ranges of radial and vertical positions in the higher flyer zones.--

Signed and Sealed this
Twenty-sixth Day of February, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,317,632 B2
APPLICATION NO. : 12/877243
DATED : November 27, 2012
INVENTOR(S) : Edward A. Nemeth and David W. Crawford It is certified that error appears in the above-identified patent and that said Letters Patent is hereby corrected as shown below:

Column 19, lines 15-42, replace claim 8 with the following re-written claim:

--A method for operating a round ride including a plurality of vehicle support assemblies extending from a rotatable central hub, comprising:

with a controller, first positioning all of the vehicle support assemblies in a low flyer zone, wherein the first positioning includes operating a base angle mechanism to pivot a base of each of the vehicle support assemblies into a low position;

rotating the central hub about a central axis at a rotation rate; and with the controller, second positioning alternating ones of the vehicle support assemblies into a high flyer zone, wherein the second positioning includes operating the base angle mechanism to pivot the base of each of the alternating ones of the vehicle support assemblies from the low position to a high position at a predefined angular offset, wherein each of the vehicle support assemblies includes an arm supporting a passenger vehicle, wherein in each of the vehicle support assemblies the arm is pivotally mounted to the base, and wherein each of the vehicle support assemblies includes an arm pivot actuator operable to pivot the arm relative to the base through an angular range of motion, whereby the passenger vehicles are positionable in ranges of radial and vertical positions in the lower flyer zone that differ from ranges of radial and vertical positions in the higher flyer zones.--

This certificate supersedes the Certificate of Correction issued February 26, 2013.

Signed and Sealed this
Nineteenth Day of March, 2013

Teresa Stanek Rea
*Acting Director of the United States Patent and Trademark Office*